US010066172B2

(12) United States Patent
Choi et al.

(10) Patent No.: US 10,066,172 B2
(45) Date of Patent: Sep. 4, 2018

(54) SUPERCRITICAL WATER UPGRADING PROCESS TO PRODUCE PARAFFINIC STREAM FROM HEAVY OIL

(71) Applicant: Saudi Arabian Oil Company, Dhahran (SA)

(72) Inventors: Ki-Hyouk Choi, Dhahran (SA); Mohammad A. AlAbdullah, Dhahran (SA); Ashok K. Punetha, Dhahran (SA); Emad N. Al-Shafei, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 8 days.

(21) Appl. No.: 15/374,289

(22) Filed: Dec. 9, 2016

(65) Prior Publication Data

US 2017/0166821 A1 Jun. 15, 2017

Related U.S. Application Data

(60) Provisional application No. 62/267,397, filed on Dec. 15, 2015.

(51) Int. Cl.
*C10G 51/02* (2006.01)
*C10G 9/36* (2006.01)
(Continued)

(52) U.S. Cl.
CPC ..... *C10G 51/023* (2013.01); *C10G 9/36* (2013.01); *C10G 47/32* (2013.01); *C10G 49/007* (2013.01);
(Continued)

(58) Field of Classification Search
CPC ..... C10G 9/36; C10G 51/00–51/04
(Continued)

(56) References Cited

U.S. PATENT DOCUMENTS 4,465,888 A 8/1984 Paspek, Jr.
4,591,426 A 5/1986 Krasuk et al.
(Continued)

FOREIGN PATENT DOCUMENTS

CA 2938409 A1 8/2015
EP 1 342 771 A1 9/2003
(Continued)

OTHER PUBLICATIONS

International Search Report and Written Opinion pertaining to PCT/US2016/066367 dated Nov. 10, 2017.
(Continued)

*Primary Examiner* — Philip Y Louie
*Assistant Examiner* — Alyssa L Cepluch
(74) *Attorney, Agent, or Firm* — Dinsmore & Shohl LLP

(57) ABSTRACT

Embodiments of a process for producing paraffins from a petroleum-based composition comprising long chain aromatics comprise mixing a supercritical water stream with a pressurized, heated petroleum-based composition to create a combined feed stream, introducing the combined feed stream to a first reactor through an inlet port of the first reactor, where the first reactor operates at supercritical pressure and temperature, cracking at least a portion of the long chain aromatics in the first reactor to form a first reactor product, and then introducing the first reactor product to a second reactor through an upper inlet port of the second reactor operating at supercritical pressure and temperature, where the second reactor is a downflow reactor comprising an upper inlet port, a lower outlet port, and a middle outlet port are provided. The middle outlet product passing out of the middle outlet port comprises paraffins and short chain aromatics.

15 Claims, 7 Drawing Sheets

(51) Int. Cl.

| | |
|---|---|
| ***C10G 75/00*** | (2006.01) |
| ***C10G 47/32*** | (2006.01) |
| ***C10G 49/00*** | (2006.01) |
| ***C10G 65/10*** | (2006.01) |

(52) U.S. Cl.
CPC ..... *C10G 65/10* (2013.01); *C10G 75/00* (2013.01); *C10G 2300/107* (2013.01); *C10G 2300/1074* (2013.01); *C10G 2300/1077* (2013.01); *C10G 2400/00* (2013.01); *C10G 2400/10* (2013.01)

(58) Field of Classification Search
USPC ..... 208/72, 125, 130
See application file for complete search history.

(56) References Cited

U.S. PATENT DOCUMENTS

| | | | | |
|---|---|---|---|---|
| 4,822,497 | A | 4/1989 | Hong et al. | |
| 5,387,398 | A | 2/1995 | Mueggenburg et al. | |
| 5,454,950 | A | 10/1995 | Li et al. | |
| 6,039,791 | A | 3/2000 | Kazeef et al. | |
| 6,306,287 | B1 | 10/2001 | Billon et al. | |
| 6,332,975 | B1 | 12/2001 | Abdel-Halim et al. | |
| 6,365,790 | B2 | 4/2002 | Reimer et al. | |
| 7,041,707 | B2 | 5/2006 | Hahn | |
| 7,435,330 | B2 | 10/2008 | Hokari et al. | |
| 7,591,983 | B2 | 9/2009 | Takahashi et al. | |
| 7,594,387 | B2 | 9/2009 | Inage et al. | |
| 7,740,065 | B2 | 6/2010 | Choi | |
| 2006/0260927 | A1 | 11/2006 | Abazajian | |
| 2008/0099374 | A1 | 5/2008 | He et al. | |
| 2008/0099376 | A1 | 5/2008 | He et al. | |
| 2008/0099378 | A1 | 5/2008 | He et al. | |
| 2009/0139902 | A1 | 6/2009 | Kressmann et al. | |
| 2009/0159489 | A1 | 6/2009 | Lopez et al. | |
| 2009/0159498 | A1 | 6/2009 | Chinn et al. | |
| 2009/0159504 | A1 | 6/2009 | Choi et al. | |
| 2009/0166262 | A1 | 7/2009 | He et al. | |
| 2011/0147266 | A1 | 6/2011 | Choi | |
| 2012/0061291 | A1 | 3/2012 | Choi et al. | |
| 2012/0061294 | A1 | 3/2012 | Choi et al. | |
| 2012/0181217 | A1 | 7/2012 | Choi et al. | |
| 2013/0140214 | A1 | 6/2013 | Choi | |
| 2013/0206645 | A1* | 8/2013 | Yarbro ..... | C10G 31/08 208/106 |
| 2013/0319910 | A1 | 12/2013 | Koseoglu et al. | |
| 2014/0135540 | A1 | 5/2014 | Iversen | |
| 2014/0251871 | A1 | 9/2014 | Choi et al. | |
| 2014/0275676 | A1 | 9/2014 | Sieli et al. | |
| 2015/0321975 | A1 | 11/2015 | Choi et al. | |
| 2016/0312129 | A1 | 10/2016 | Choi et al. | |

FOREIGN PATENT DOCUMENTS

| | | | |
|---|---|---|---|
| EP | 1 616 931 | A1 | 1/2006 |
| EP | 1696019 | A1 | 8/2006 |
| GB | 1298904 | A | 1/1971 |
| JP | 2000109850 | | 4/2000 |
| JP | 2003049180 | | 2/2003 |
| KR | 100249496 | B1 | 3/2000 |
| WO | 2008055152 | A1 | 5/2008 |
| WO | 2013033301 | A2 | 3/2013 |
| WO | 2015094948 | A1 | 6/2015 |

OTHER PUBLICATIONS

Office Action pertaining to U.S. Appl. No. 15/374,203 dated Oct. 31, 2017.
Office Action pertaining to U.S. Appl. No. 15/374,295 dated Oct. 31, 2017.
Ates et al., "The Role of Catalyst in Supercritical Water Desulfurization", Applied Catalysis B: Environmental, 2014, 147, 144-155, Elsevier B.V.
Badger et al., "Viscosity Reduction in Extra Heavy Crude Oils", 461-465, The Laboratory for Hydrocarbon Process Chemistry, The Pennsylvania State University, Symposium Proceeding, ACS Division of Fuel Chemistry Meeting 216, 1998.
Escallon, Maria M., "Petroleum and Petroleum/Coal Blends as Feedstocks in Laboratory-Scale and Pilot-Scale Cokers to Obtain Carbons of Potentially High Value", A Thesis in Fuel Science, 2008, The Pennsylvania State University Graduate School.
Hughes et al., "Conocophillips Delayed Coking Process", Handbook of Petroleum Refining Processes, 2003, Chapter 12, 3rd Edition, 12.3-12.31, McGraw-Hill, New York (NY).
Iqbal et al., "Unlocking Current Refinery Constraints", PTQ Q2 2008, www.digitalrefining.com/article/1000682.
Kishita et al., "Desulfurization of Bitumen by Hydrothermal Upgrading Process in Supercritical Water with Alkali", Journal of the Japan Petroleum Institute, 2006, 49 (4), 1779-185.
International Search Report and Written Opinion pertaining to PCT/US2016/066129 dated Mar. 13, 2017.
International Search Report pertaining to PCT International Application No. PCT/US2018/012027, filed Jan. 2, 2018, 5 pages.
Written Opinion pertaining to PCT International Application No. PCT/US2018/012027, filed Jan. 2, 2018, 6 pages.
Final Office Action dated Mar. 16, 2018, pertaining to U.S. Appl. No. 15/374,295, filed Dec. 9, 2016, 13 pages.
Notice of Allowance dated Mar. 22, 2018, pertaining to U.S. Appl. No. 15/374,203, filed Dec. 9, 2016, 8 pages.
Abdulrazak et al., "Problems of Heavy Oil Transportation in Pipelines and Reduction of High Viscosity", Iraqi Journal of Chemical and Petroleum Engineering, 2015, vol. 16, No. 3, 1-9.
Gateau et al., "Heavy Oil Dilution", Oil & Gas Science and Technology, 2004, vol. 59, No. 5, 503-509.
International Search Report and Written Opinion pertaining to PCT/US2016/066132 dated Mar. 21, 2017.
International Search Report and Written Opinion pertaining to PCT/US2016/066294 dated Mar. 21, 2017.
Notice of Allowance pertaining to U.S. Appl. No. 15/377,351 dated Nov. 7, 2018.
International Search Report dated Mar. 23, 2018 for International Application No. PCT/US2017/068464, filed Dec. 27, 2017, 6 pages.
Written Opinion dated Mar. 23, 2018 for International Application No. PCT/US2017/068464, filed Dec. 27, 2017, 5 pages.

* cited by examiner

SUPERCRITICAL WATER UPGRADING PROCESS TO PRODUCE PARAFFINIC STREAM FROM HEAVY OIL

CROSS-REFERENCE TO RELATED APPLICATIONS

This application claims priority to U.S. Provisional Application 62/267,397, filed Dec. 15, 2015, which is incorporated by reference in its entirety.

TECHNICAL FIELD

Embodiments of the present disclosure generally relate to supercritical water upgrading processes and systems, and more specifically relate to supercritical water upgrading processes for producing paraffinic streams from heavy oil.

BACKGROUND

Lube base oil is a mixture of hydrocarbons having ranging carbon numbers from 15 to 50 that is used as major stock for lubricating oil. The base oil mainly consists of paraffinic compounds containing minor impurities, such as aromatics, naphthenes and olefins. The most important properties of lube base oil are viscosity index and pour point. Viscosity index is an indicator for viscosity stability for the lube base oil. Paraffins—particularly iso-paraffins—have a higher viscosity index than other groups of compounds while keeping pour point in acceptable range. N-paraffins have high viscosity index but high pour point, and thus are solid or very thick liquid under ambient conditions. In some instances, lube base oil may have a viscosity index higher than 120 and a pour point of −24° C. to −12° C.

Lube base oil is conventionally produced from crude oil or other hydrocarbon sources, such as coal liquid. Most lube base oil comes from crude oil distillation. In order to yield a product with the requisite viscosity index, pour point, and oxidative stability, many steps are required. Typical processing units for lube base oil production include solvent extraction, catalytic dewaxing, catalytic hydroprocessing, and combination of these. Solvent extraction generally extracts aromatics from vacuum gas oil for preparing highly paraffinic fractions that are eventually converted to lube base oil after certain operations, including catalytic dewaxing and hydrofinishing. When solvent extraction is the first step to produce lube base oil, the available amount of paraffinic compounds are restricted because of the limited conversion capability of catalytic dewaxing and hydrofinishing. Moreover, solvent extraction is ineffective at removing aromatics and other impurities. Specifically, the presence of a small amount of naphthenes (cycloalkanes) in lube base oil can greatly reduce the viscosity index.

Hydrocracking is also used to produce lube base oil; however, hydrocracking does not significantly increase the amount of paraffinic compounds but rather is limited to the amount of paraffinic compounds present in crude oil. Hydrocracking also consumes a large amount of hydrogen and requires a high severity process to sufficiently crack long paraffinic compounds.

Thermal processing procedures, such as catalytic hydroprocessing and delayed coking, are also conventionally utilized in the production of lube base oil; however, thermal processing detrimentally produces a large amount of low economic value products, such as light gas and solid coke. In delayed coking, where molecules in the petroleum feed may be converted to light gas and solid coke through radical reactions, the product may have light gases and solid coke present in amounts as high as 10 weight % and 30 weight %, respectively.

SUMMARY

Accordingly, ongoing needs exist for processes for producing lube base oil that consume less hydrogen, increase the yield of paraffinic compounds, remove aromatics and other impurities, and reduce overcracking and coking.

The present embodiments utilize supercritical water to meet these needs while also providing a new methodology for lube base oil production. The application of supercritical water to a petroleum feedstock is an effective technique for upgrading hydrocarbons and desulfurization, while reducing coking. Embodiments of the present disclosure are directed to the utilization of supercritical water to produce a paraffin-containing product stream, while minimizing the concentration of olefins produced to less than 1 weight %.

In one embodiment, a process for producing paraffins from a petroleum-based composition comprising long chain aromatics is provided. The process comprises mixing a supercritical water stream with a pressurized, heated petroleum-based composition to create a combined feed stream, where the supercritical water stream is at a pressure greater than a critical pressure of water and at a temperature greater than a critical temperature of water and where the pressurized, heated petroleum-based composition is at a pressure greater than the critical pressure of water and at a temperature greater than 75° C. The process also comprises introducing the combined feed stream to a first reactor through an inlet port of the first reactor, where the first reactor operates at a first temperature greater than the critical temperature of water and a first pressure greater than the critical pressure of water, and cracking at least a portion of the long chain aromatics in the first reactor to form a first reactor product, where the first reactor product comprises water, paraffins, short chain aromatics, olefins, and unconverted long chain aromatics. The process further includes introducing the first reactor product to a second reactor through an upper inlet port of the second reactor, the second reactor operating at a second temperature less than the first temperature but greater than the critical temperature of water and a second pressure greater than the critical pressure of water, where the second reactor is a downflow reactor comprising the upper inlet port, a lower outlet port, and a middle outlet port disposed between the upper inlet port and the lower outlet port, where the second reactor has a volume less than or equal to a volume of the first reactor, where a middle outlet product is passed out of the second reactor though the middle outlet port, the middle outlet product comprising paraffins and short chain aromatics, and where a lower outlet product is passed out of the second reactor through the lower outlet port, the lower outlet product comprising multi-ring aromatics and oligomerized olefins. Moreover, the process comprises cooling the middle outlet product to a temperature less than 200° C., reducing the pressure of the cooled middle outlet product to create a cooled, depressurized middle stream with a pressure from 0.05 megapascals (MPa) to 2.2 MPa, at least partially separating the cooled, depressurized middle stream into a gas-phase stream and a liquid-phase stream, where the liquid-phase stream comprises water, short chain aromatics, and paraffins, at least partially separating the liquid-phase stream into a water-containing stream and an oil-containing stream, where the oil-containing stream comprises paraffins and short chain aromatics, and at least partially separating the paraffins and the short chain aromatics from the oil-containing stream.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

Figure 1:
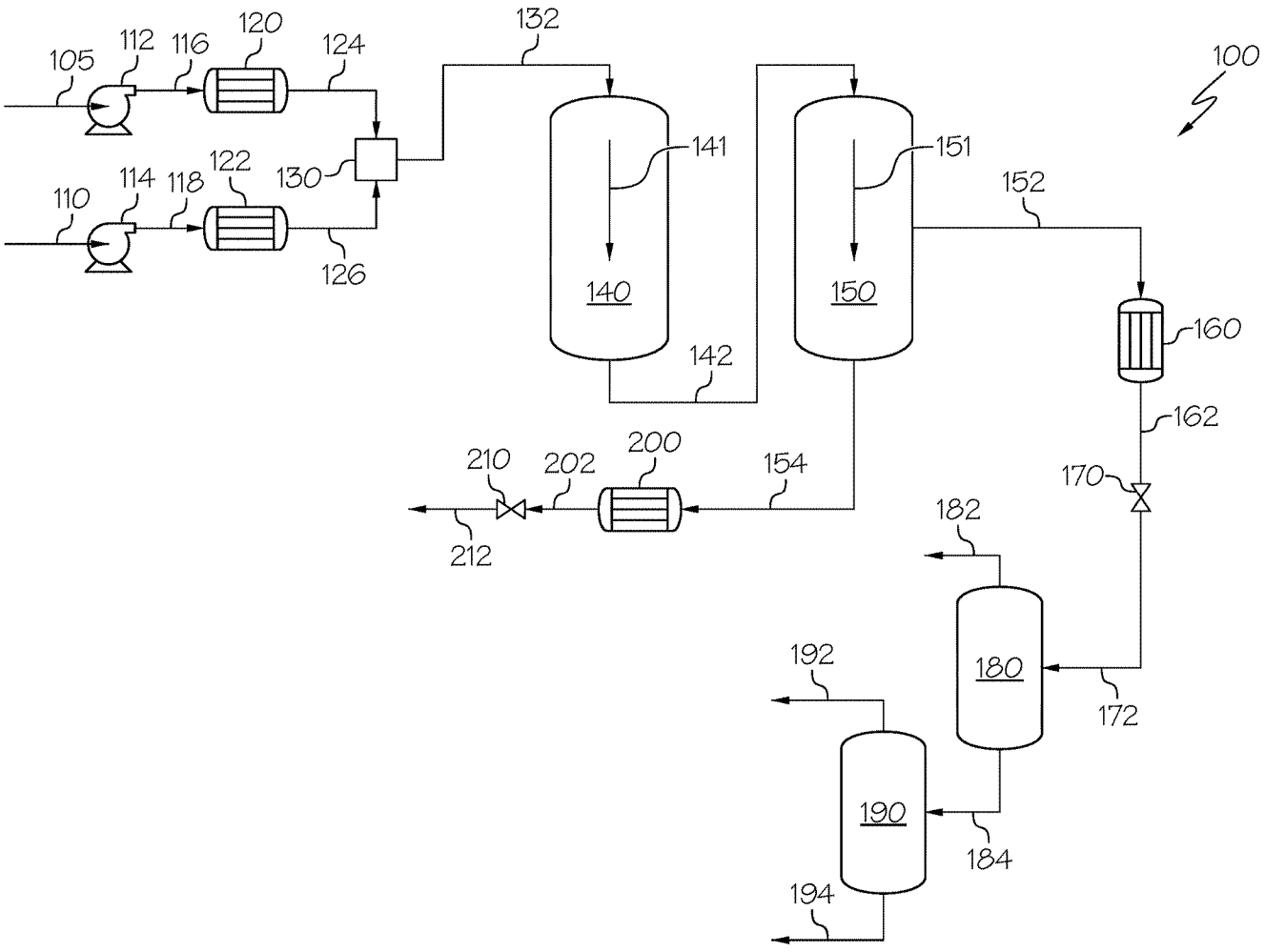
FIG. 1 is a diagram of a system used for supercritical water upgrading to produce a paraffin-containing product stream according to one or more embodiments of the present disclosure.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

DETAILED DESCRIPTION

Embodiments of the present disclosure are directed to producing a paraffin-containing product stream and an aromatic product stream from petroleum-based compositions through the use of supercritical water. As used throughout the disclosure, "supercritical" refers to a substance at a pressure and a temperature greater than that of its critical pressure and temperature, such that distinct phases do not exist and the substance may exhibit the diffusion of a gas while dissolving materials like a liquid. At a temperature and pressure greater than the critical temperature and pressure of water, the liquid and gas phase boundary of water and steam disappears, and the fluid has characteristics of both fluid and gaseous substances. Supercritical water is able to dissolve organic compounds like an organic solvent and has excellent diffusibility like a gas. Regulation of the temperature and pressure allows for continuous "tuning" of the properties of the supercritical water to be more liquid or more gas like. Supercritical water has reduced density and lesser polarity, as compared to liquid-phase sub-critical water, thereby greatly extending the possible range of chemistry, which can be carried out in water.

Without being bound by theory, supercritical water has various unexpected properties as it reaches supercritical boundaries. Supercritical water has very high solubility toward organic compounds and has an infinite miscibility with gases. Furthermore, radical species can be stabilized by supercritical water through the cage effect (that is, a condition whereby one or more water molecules surrounds the radical species, which then prevents the radical species from interacting). The stabilization of radical species may help prevent inter-radical condensation and thereby reduces the overall coke production in the current embodiments. For example, coke production can be the result of the inter-radical condensation. In certain embodiments, supercritical water generates hydrogen gas through a steam reforming reaction and water-gas shift reaction, which is then available for the upgrading reactions.

As mentioned, in embodiments, supercritical water may be used to produce a paraffin-containing product stream and an aromatic product stream from petroleum-based compositions. Without being limited to industrial application, the paraffinic product stream may be suitable for incorporation in lube base oil, and the aromatic product may be used as a component for motor fuel or feedstock for aromatics production. The present embodiments include a supercritical water reactor system which converts aromatic compounds having long paraffinic side chain into long chain paraffinic compounds and short chain aromatics without producing significant amount of olefinic compounds. The supercritical water reactor system also produces light aromatics and paraffinic compounds from polynuclear aromatics, olefins, and asphalthenic compounds.

The long chain aromatics refer to aromatic hydrocarbon compositions including a paraffin (alkane) chain of at least 7 carbons attached to an aromatic ring. One of many examples is hexadecyl benzene. Similarly, long chain paraffins refer to refer to alkanes of at least 7 carbons. Conversely, short chain aromatics refer to hydrocarbon compositions having a paraffin chain of less than 7 carbons attached to an aromatic ring.

Referring to FIG. 1, embodiments of a process 100 for producing paraffins from a petroleum-based composition 105 comprising long chain aromatics in the presence of supercritical water are depicted. The petroleum-based composition 105 may refer to any hydrocarbon source derived from petroleum, coal liquid, or biomaterials. Exemplary hydrocarbon sources for petroleum-based composition 105 may include whole range crude oil, distilled crude oil, residue oil, topped crude oil, product streams from oil refineries, product streams from steam cracking processes, liquefied coals, liquid products recovered from oil or tar sands, bitumen, oil shale, asphaltene, biomass hydrocarbons, and the like. In a specific embodiment, the petroleum-based composition 105 may include atmospheric residue (AR), vacuum gas oil (VGO), or vacuum residue (VR). In another embodiment, the petroleum-based composition 105 may have monoaromatic and diaromatic contents of over 1 weight % (wt %). Additionally, the petroleum-based composition 105 may contain at least 5 wt % of vacuum residue fraction which is defined to have boiling point higher than 1050° F. (about 565.6° C.).

As shown in FIG. 1, the petroleum-based composition 105 may be pressurized in a pump 112 to create a pressurized petroleum-based composition 116. The pressure of pressurized petroleum-based composition 116 may be at least 22.1 MPa, which is approximately the critical pressure of water. Alternatively, the pressure of the pressurized petroleum-based composition 116 may be between 22.1

MPa and 32 MPa, or between 23 MPa and 30 MPa, or between 24 MPa and 28 MPa. In some embodiments, the pressure of the pressurized petroleum-based composition 116 may be between 25 MPa and 29 MPa, 26 MPa and 28 MPa, 25 MPa and 30 MPa, 26 MPa and 29 MPa, or 23 MPa and 28 MPa.

Referring again to FIG. 1, the pressurized petroleum-based composition 116 may then be heated in one or more petroleum pre-heaters 120 to form a pressurized, heated petroleum-based composition 124. In one embodiment, the pressurized, heated petroleum-based composition 124 has a pressure greater than the critical pressure of water as described previously and a temperature greater than 75° C. Alternatively, the temperature of the pressurized, heated petroleum-based composition 124 is between 10° C. and 300° C., or between 50° C. and 250° C., or between 75° C. and 200° C., or between 50° C. and 150° C., or between 50° C. and 100° C. In some embodiments, the temperature of the pressurized, heated petroleum-based composition 124 may be between 75° C. and 225° C., or between 100° C. and 200° C., or between 125° C. and 175° C., or between 140° C. and 160° C.

Embodiments of the petroleum pre-heater 120 may include a natural gas fired heater, heat exchanger, or an electric heater. In some embodiments, the pressurized, heated petroleum-based composition 124 is heated in a double pipe heat exchanger later in the process.

As shown in FIG. 1, the water stream 110 may be any source of water, for example, a water stream 110 having a conductivity less than 1 microsiemens (μS)/centimeters (cm), such as less than 0.5 μS/cm or less than 0.1 μS/cm. Exemplary water streams 110 include demineralized water, distillated water, boiler feed water (BFW), and deionized water. In at least one embodiment, water stream 110 is a boiler feed water stream. Water stream 110 is pressurized by pump 114 to produce a pressurized water stream 118. The pressure of the pressurized water stream 118 is at least 22.1 MPa, which is approximately the critical pressure of water. Alternatively, the pressure of the pressurized water stream 118 may be between 22.1 MPa and 32 MPa, or between 22.9 MPa and 31.1 MPa, or between 23 MPa and 30 MPa, or between 24 MPa and 28 MPa. In some embodiments, the pressure of the pressurized water stream 118 may be 25 MPa and 29 MPa, 26 MPa and 28 MPa, 25 MPa and 30 MPa, 26 MPa and 29 MPa, or 23 MPa and 28 MPa.

Referring again to FIG. 1, the pressurized water stream 118 may then be heated in a water pre-heater 122 to create a supercritical water stream 126. The temperature of the supercritical water stream 126 is greater than about 374° C., which is approximately the critical temperature of water. Alternatively, the temperature of the supercritical water stream 126 may be between 374° C. and 600° C., or between 400° C. and 550° C., or between 400° C. and 500° C., or between 400° C. and 450° C., or between 450° C. and 500° C. In some embodiments, the maximum temperature of the supercritical water stream 126 may be 600° C., as the mechanical parts in the supercritical reactor system may be affected by temperatures greater than 600° C.

Similar to the petroleum pre-heater 120, suitable water pre-heaters 122 may include a natural gas fired heater, a heat exchanger, and an electric heater. The water pre-heater 122 may be a unit separate and independent from the petroleum pre-heater 120.

As mentioned, supercritical water has various unexpected properties as it reaches its supercritical boundaries of temperature and pressure. For instance, supercritical water may have a density of 0.123 grams per milliliter (g/mL) at 27 MPa and 450° C. In comparison, if the pressure was reduced to produce superheated steam, for example, at 20 MPa and 450° C., the steam would have a density of only 0.079 g/mL. At that density, the hydrocarbons may react with superheated steam to evaporate and mix into the liquid phase, leaving behind a heavy fraction 182 that may generate coke upon heating. The formation of coke or coke precursor may plug the lines and must be removed. Therefore, supercritical water is superior to steam in some applications.

Referring again to FIG. 1, the supercritical water stream 126 and the pressurized, heated petroleum-based composition 124 may be mixed in a feed mixer 130 to produce a combined feed stream 132. The feed mixer 130 can be any type of mixing device capable of mixing the supercritical water stream 126 and the pressurized, heated petroleum stream 124. In one embodiment, feed mixer 130 may be a mixing tee, a homogenizer, an ultrasonic mixer, a small continuous stir tank reactor (CSTR), or any other suitable mixer.

Referring to FIG. 1, the combined feed stream 132 may then be introduced to a supercritical reactor system configured to upgrade the combined feed stream 132. The supercritical reactor system includes at least two reactors, a first reactor 140 and a second reactor 150. The combined feed stream 132 is fed through an inlet port of the first reactor 140. The first reactor 140 depicted in FIG. 1 is a downflow reactor where the inlet port is disposed near the top of the first reactor 140 and the outlet port is disposed near the bottom of the first reactor 140. In alternative embodiments, it is contemplated that the first reactor 140 may be an upflow reactor where the inlet port is disposed near the bottom of the reactor. As shown by arrow 141, a downflow reactor is a reactor where the petroleum upgrading reactions occur as the reactants travel downward through the reactor. Conversely, an upflow reactor is a reactor where the petroleum upgrading reactions occur as the reactants travel upward through the reactor.

As stated previously, the first reactor 140 is a supercritical reactor that operates at a first temperature greater than the critical temperature of water and a first pressure greater than the critical pressure of water. In one or more embodiments, the first reactor 140 may have a temperature of between 400° C. to 500° C., or between 420° C. to 460° C. The first reactor 140 may be an isothermal or nonisothermal reactor. The reactor may be a tubular-type vertical reactor, a tubular-type horizontal reactor, a vessel-type reactor, a tank-type reactor having an internal mixing device, such as an agitator, or a combination of any of these reactors. Moreover, additional components, such as a stirring rod or agitation device may also be included in the first reactor 140.

The first reactor 140 may have dimensions defined by the equation L/D, where L is a length of the first reactor 140 and D is the diameter of the first reactor 140. In one or more embodiments, the L/D value of the first reactor 140 may be sufficient to achieve a superficial velocity of fluid greater than 0.5 meter (m)/minute (min), or an L/D value sufficient to a achieve superficial velocity of fluid between 1 m/min and 25 m/min, or an L/D value sufficient to a achieve superficial velocity of fluid between 1 m/min and 5 m/min. The fluid flow may be defined by a Reynolds number greater than about 5000.

In one or more embodiments, the first reactor 140 and the second reactor 150 are both supercritical water reactors, which employ supercritical water as the reaction medium for upgrading reactions in the absence of externally-provided hydrogen gas and in the absence of a catalyst. In alternative embodiments, hydrogen gas may be delivered through a steam reforming reaction and water-gas shift reaction, which is then available for used in the upgrading reactions.

In operation, long chain aromatics of the combined feed stream 132 are at least partially cracked in the first reactor 140 to form a first reactor product 142, where the first reactor product 142 comprises water, paraffins, short chain aromatics, olefins, and unconverted long chain aromatics. The long chain aromatics, which may include aromatic compounds having long chain paraffins such as hexadecyl benzene, may be cracked through β-scission to produce toluene or xylene-like aromatic compounds and paraffins or olefins. For example as shown in Reaction 1, hexadecyl benzene will be cracked by β-scission to produce a long chain olefin $C_{15}H_{30}$ (olefin with one double bond) and toluene. As shown in Reaction 2, the $C_{15}H_{30}$ long chain olefin can extract a hydrogen from another hydrocarbons to be saturated to $C_{15}H_{32}$.

Reaction 1: β-Scission

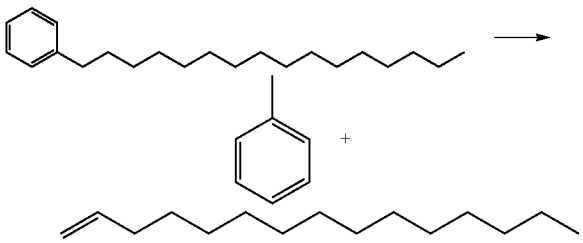

Reaction 2: Saturating the Long Chain Olefin

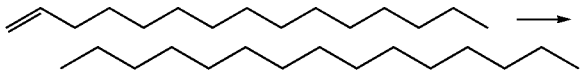

Without being limited to theory, the cracking reaction in the first reactor 140 in the presence of supercritical water follows the radical mechanisms which dominate reactions in conventional thermal cracking. In these radical mechanisms, hydrocarbon chemical bonds are broken to generate radicals which are propagated to other molecules to initiate chain reaction. However, the supercritical water acts as a solvent to dilute and stabilize the radicals, and acts as a hydrogen transfer agent. The relative amount of paraffin and olefin products and distribution of carbon numbers of products strongly depend on the phase where the thermal cracking occurs. Under the liquid phase cracking, there is fast hydrogen transfer between molecules which facilitates more formation of paraffins than gas-phase cracking. Also, liquid phase cracking shows generally even distribution of carbon numbers of product, while gas phase cracking has more light paraffins and olefins in the product. While hydrocarbon conversion reaction in supercritical water seems to follow both types, gas-phase and liquid-phase cracking, depending on water/hydrocarbon ratio, temperature, and pressure.

The present embodiments may maintain ratios of water to hydrocarbon to maximize paraffin yield while driving olefins to heavier molecules through oligomerization. The volumetric flow ratio of supercritical water to petroleum fed to the feed mixer 130 may vary to control the ratio of water-to-oil (water:oil) in the first reactor 140. In one embodiment, the volumetric flow ratio of water:oil may be from 10:1 to 1:1, or 10:1 to 1:10, or 5:1 to 1:1, or 4:1 to 1:1, or 2:1 to 1:1 at standard ambient temperature and pressure (SATP). Without being bound by any particular theory, controlling the water:oil ratio may aid in converting olefins to other components, such as iso-paraffins. In some embodiments, the ratio of water:oil may be greater than 1 to prevent the formation of coke. In some embodiments, the ratio of water:oil may be less than 5, as diluting the olefin solution may allow for olefins to pass through the first reactor 140 unreacted and the first reactor 140 may require additional energy consumption to heat the large amounts of water if the ratio of water:oil is greater than 5.

In order to produce paraffin, hydrogen transfer between hydrocarbons should be facilitated by high concentration of hydrocarbons as well as presence of hydrogen transfer agent such as $H_2S$. Also, paraffins should leave the reactor as soon as formed to prevent further cracking. Thus, the residence time within the first reactor 140 may be from 0.5 minutes to 60 minutes, or 5 minutes to 15 minutes. The residence time, in some embodiments, may be between 2 and 30 minutes, or between 2 and 20 minutes, or between 5 and 25 minutes, or between 5 and 10 minutes.

Referring again to FIG. 1, the first reactor product 142 may be introduced to a second reactor 150 through an upper inlet port of the second reactor 150. The second reactor 150 is a downflow reactor comprising an upper inlet port, a lower outlet port, and a middle outlet port disposed between the upper inlet port and lower outlet port. The second reactor 150 operates at a second temperature less than the first temperature of the first reactor 140 but greater than the critical temperature of water. The second reactor 150 also has a second pressure greater than the critical pressure of water. In one or more embodiments, the second reactor 150 may have a temperature of from 380° C. to 450° C., or from 400° C. to 420° C. The second reactor 150 may have a lower operating temperature than the first reactor 140 to minimize further thermal cracking of long chain paraffins in the first reactor product 142. In one or more embodiments, the temperature difference between the first reactor 140 and the second reactor 150 is from 10° C. to 50° C., or from 15° C. to 30° C.

In operation, the reactions in the second reactor 150 yield a middle outlet product 152 that is passed out of a middle outlet port, where the middle outlet product 152 comprises paraffins and short chain aromatics. In one or more embodiment, the middle outlet product 152 comprises less than 1 weight % (wt %) olefins, or less than 0.5 wt % olefins, or less than 0.1 wt % olefins. Moreover, the reactions in the second reactor 150 yield a lower outlet product 154 that is passed out of the second reactor 150 through a lower outlet port, where the lower outlet product 154 comprises multi-ring aromatics and oligomerized olefins. For example, and not by way of limitation, the multi-ring aromatics may include asphaltenes.

The second reactor 150 may also have dimensions defined by the equation L/D, where L is a length of the second reactor 150 and D is the diameter of the second reactor 150. In one or more embodiments, the L/D value of the second reactor 150 may be sufficient to achieve a superficial velocity of fluid greater than 0.1 m/min, or an L/D value sufficient to a achieve superficial velocity of fluid between 0.5 m/min and 3 m/min. The residence time within the second reactor 150 may be in the range of from 0.5 minutes to 60 minutes, or 5 minutes to about 15 minutes. The residence time may be between 2 and 30 minutes, or between 2 and 20 minutes or between 5 and 25 minutes or between 5 and 10 minutes.

The second reactor 150 may have a volume less than or equal to a volume of the first reactor 140. In one or more embodiments, a ratio of the volume of the first reactor 140 to the volume of the second reactor 150 is from 0.1:1 to 1:1, or from 0.5:1 to 1:1. Like the first reactor 140, the second reactor 150 may in further embodiments also include an agitating or stirring device.

Referring to FIG. 1, upon exiting the reactor, the middle outlet product 152 may be cooled in a cooler 160 to a cooled middle outlet product 162 having a temperature less than 200° C. Various cooling devices are contemplated for the cooler 160, such as a heat exchanger. Next, the pressure of the cooled middle outlet product 162 may be reduced to create a depressurized, cooled middle stream 172 with a pressure from 0.05 MPa to 2.2 MPa. The depressurizing can be achieved by many devices, for example, a valve 170 as shown in FIG. 1.

The depressurized, cooled middle stream 172 may then be fed to a gas-liquid separator 180 to separate the depressurized, cooled middle stream 172 into a gas-phase stream, heavy fraction 182 and a liquid-phase stream 184. The liquid-phase stream 184 comprises water, short chain aromatics, and paraffins. Various gas-liquid separators are contemplated herein, for example, a flash drum.

The liquid-phase stream 184 may then be fed to an oil-water separator 190 to separate the liquid-phase stream 184 into a water-containing stream 194 and an oil-containing stream 192, where the oil-containing stream 192 comprises paraffins and short chain aromatics. Various oil-liquid separators are contemplated herein, for example, a centrifugal oil-gas separator. In alternative embodiments, the oil-liquid separator may comprise several large horizontal vessels which facilitates the separation with the aid of a demulsification agent.

Figure 2:
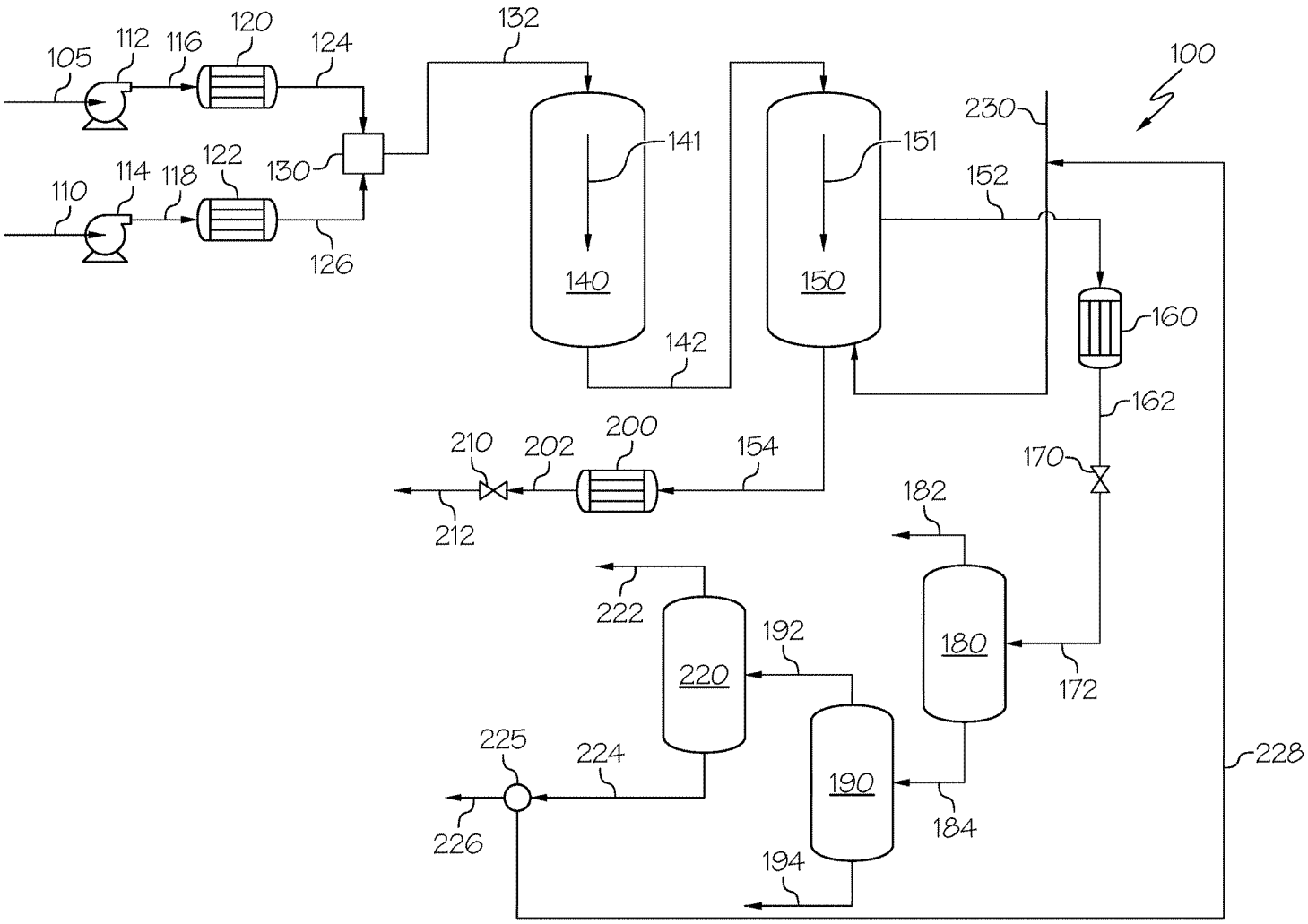
FIG. 2 is diagram of an alternate system used for supercritical water upgrading to produce a paraffin-containing product stream according to one or more embodiments of the present disclosure.

FIG. 2 also depicts a process 100 for producing paraffins, which may be in accordance with any of the embodiments previously described with reference to FIG. 1. Referring to FIGS. 1 and 2, the lower outlet product 154 may be cooled in a cooling unit 200 to achieve a cooled lower outlet product 202, which may have a temperature below 200° C. Next, the cooled lower outlet product 202 may be depressurized by a depressurization device 210, for example, a depressurization valve to achieve a cooled, depressurized lower outlet product 212, which has multi-ring aromatics and oligomerized olefins. In a further embodiment, the system may further comprise a mechanical mixer (for example, a continuous stirred tank reactor) proximate the outlet port of the second reactor 150.

Figure 3:
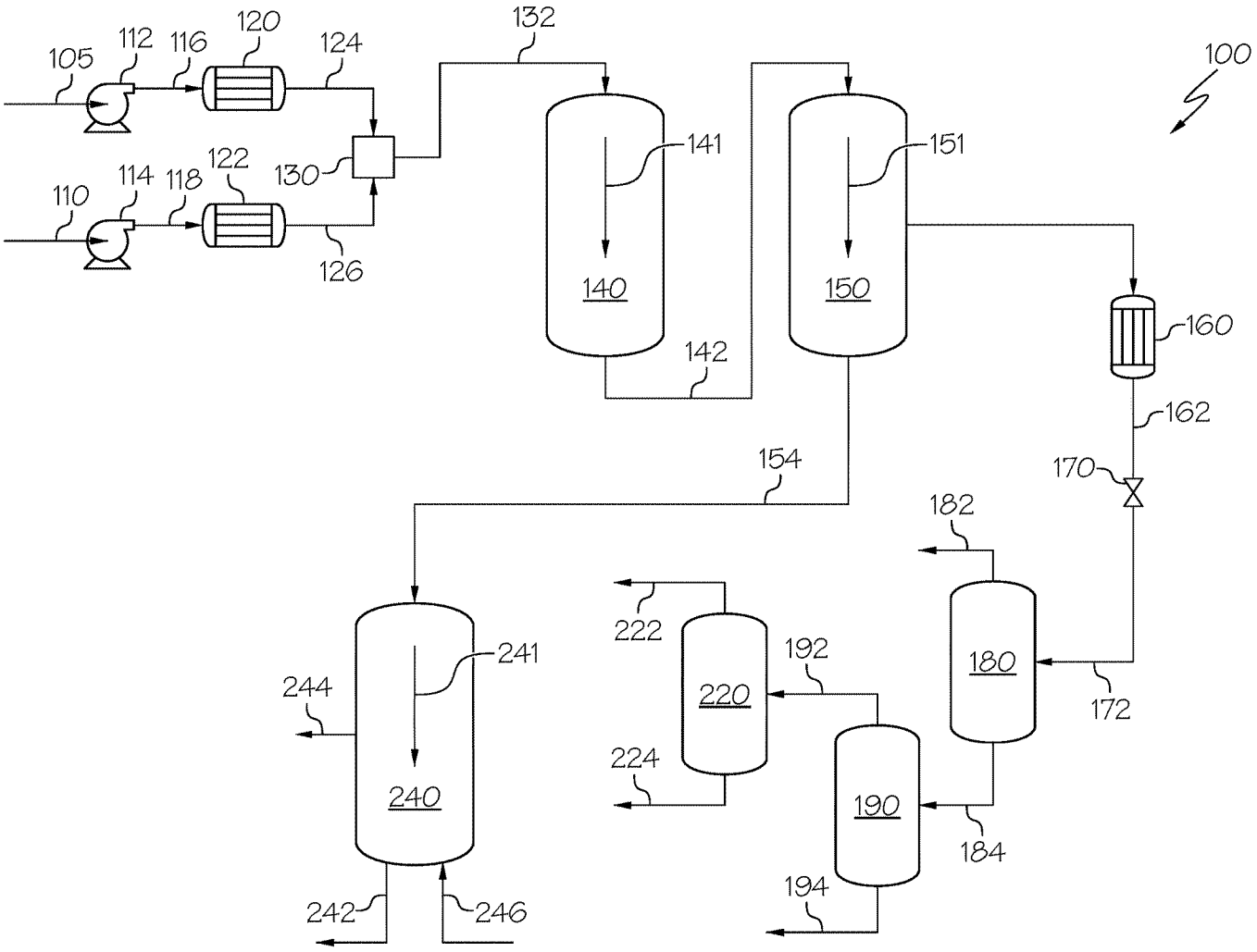
FIG. 3 is a diagram of yet another alternate system used for supercritical water upgrading to produce a paraffin-containing product stream according to one or more embodiments of the present disclosure.

FIG. 3 also depicts a process 100 for producing paraffins, which may be in accordance with any of the embodiments previously described with reference to FIGS. 1 and 2. Referring to the embodiments of FIGS. 2 and 3, the oil-containing stream 192 may be fed to another separator, for example, a solvent extraction unit 220, to at least partially separate the paraffins 222 and the short chain aromatics 224. In another embodiment, a distillation unit may be included to assist in the paraffin separation. Referring to FIG. 2, a portion 228 of the short chain aromatics 224 may be recycled to second reactor 150 to prevent plugging, which is essentially the build-up of coke or other solids within a reactor that impedes the flow. Specifically as shown, the short chain aromatics 224 may be delivered to a splitter 225, which diverts the recycle portion 228 for plug removal, while the remaining short chain aromatics 226 may be discarded or utilized in other industrial processes or applications. The embodiment of FIG. 2 shows plug remover stream 230, which comprises aromatics such as toluene or other solvents, being delivered to the bottom port of the second reactor 150; however, it is contemplated to be directed to other parts of the system. Moreover, in addition to controlling flow by regulating potential plugging in the second reactor 150, the flow within the second reactor 150 may also be controlled by regulating the opening and closing of the lower port of second reactor 150.

Referring to FIG. 3, the process 100 for producing paraffins may also include a third supercritical reactor 240, which converts the lower outlet product 154 into deasphalted oil stream 244, which is transferred out of the middle port, and transfers asphaltene out of the lower port via asphaltene stream 242. Similar to above, a plug remover solution 246 may be added to remove plugging by injecting into the bottom port of third supercritical reactor 240.

Embodiment of the present disclosure may also include many additional standard components or equipment that enables and makes operable the described processes. Examples of such standard equipment known to one of ordinary skill in the art includes heat exchanges, pumps, blowers, reboilers, steam generation, condensate handling, membranes, single and multi-stage compressors, separation and fractionation equipment, valves, switches, controllers and pressure-, temperature-, level- and flow-sensing devices.

EXAMPLES

The following two examples (Comparative Example and Present Example) are simulations that demonstrate the improved results achieved from a downflow reactor having middle and bottom outlet ports.

Referring to FIG. 1 for illustration of the process 100, the petroleum-based composition 105 used as a feed was an atmospheric residue fraction having cut point of 650° F. sampled from a Refinery. The flow rates of the water stream 110 and the petroleum-based composition 105 may be 0.8 L/hour and 0.2 L/hour at standard ambient temperature and pressure (SATP), respectively. The petroleum-based composition 105 and the water stream 110 were pressurized by separate pumps 112 and 114, respectively, and then preheated using independent heaters 120 and 122 to temperatures of 380° C. and 100° C. After combining the supercritical water stream 126 and pressurized, heated petroleum-based composition 124 by a simple tee fitting, the combined feed stream 132 was injected to the first reactor 140 from a top port. The first reactor product 142 was passed from the bottom part of the first reactor 140. In both examples, the first reactor 140 was set at a temperature of 420° C. and a pressure of 27 MPa.

For the Present Example, the second reactor 150 had three ports as depicted in FIG. 1: a top port for receiving effluent from the first reactor 140; a middle port for discharging the highly paraffinic middle outlet product 152; and a bottom port for the heavy fraction lower outlet product 154. In contrast, the comparative example had a second reactor 150 with only two ports: one top port for receiving the first reactor product 142 from the first reactor 140 and a bottom outlet port. In both examples, the temperature of the second reactor 150 was 400° C. and the pressure was 27 MPa.

Referring to FIG. 1 again, the middle outlet product 152 from the middle port of the second reactor 150 was cooled by double pipe type cooler 160 reduce the temperature down to 80° C. Then, the cooled middle outlet product 162 was depressurized by a back pressure regulator, valve 170. The cooled middle stream 172 then underwent gas-oil-water separation.

Figure 4:
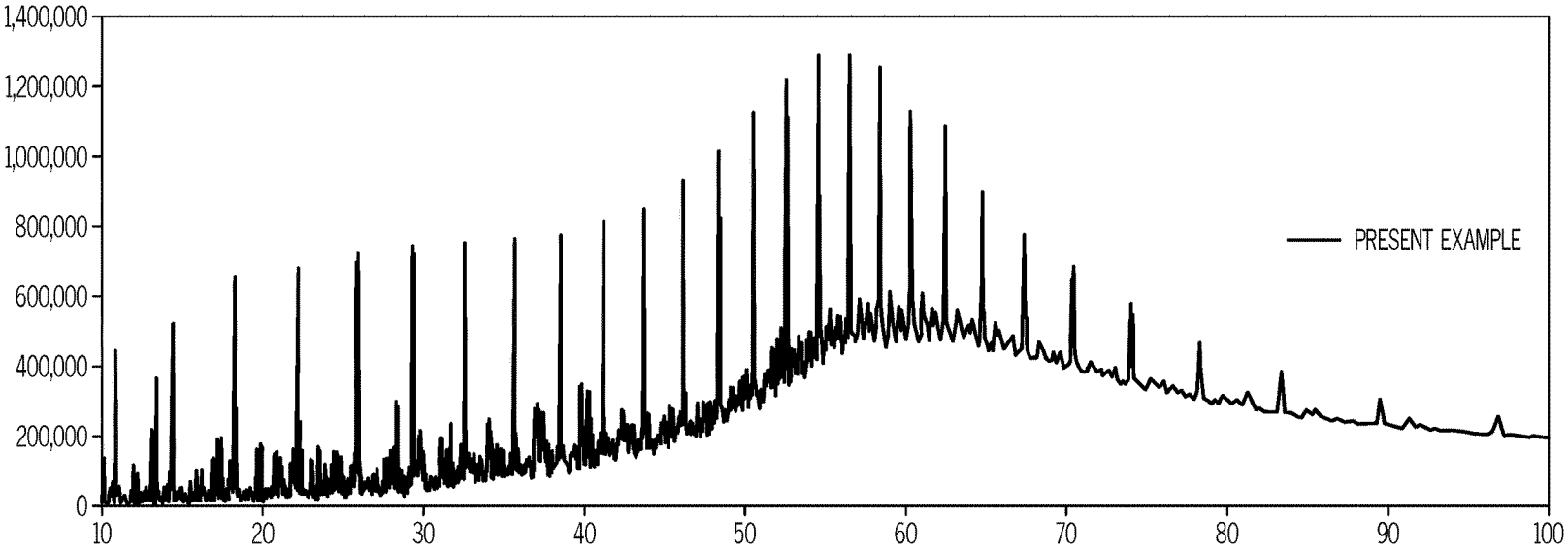
FIG. 4 is a gas chromatography-mass spectrometry (GC-MS) spectra of a middle outlet product stream according to a Present Examples described in the Examples below.
Figure 6:
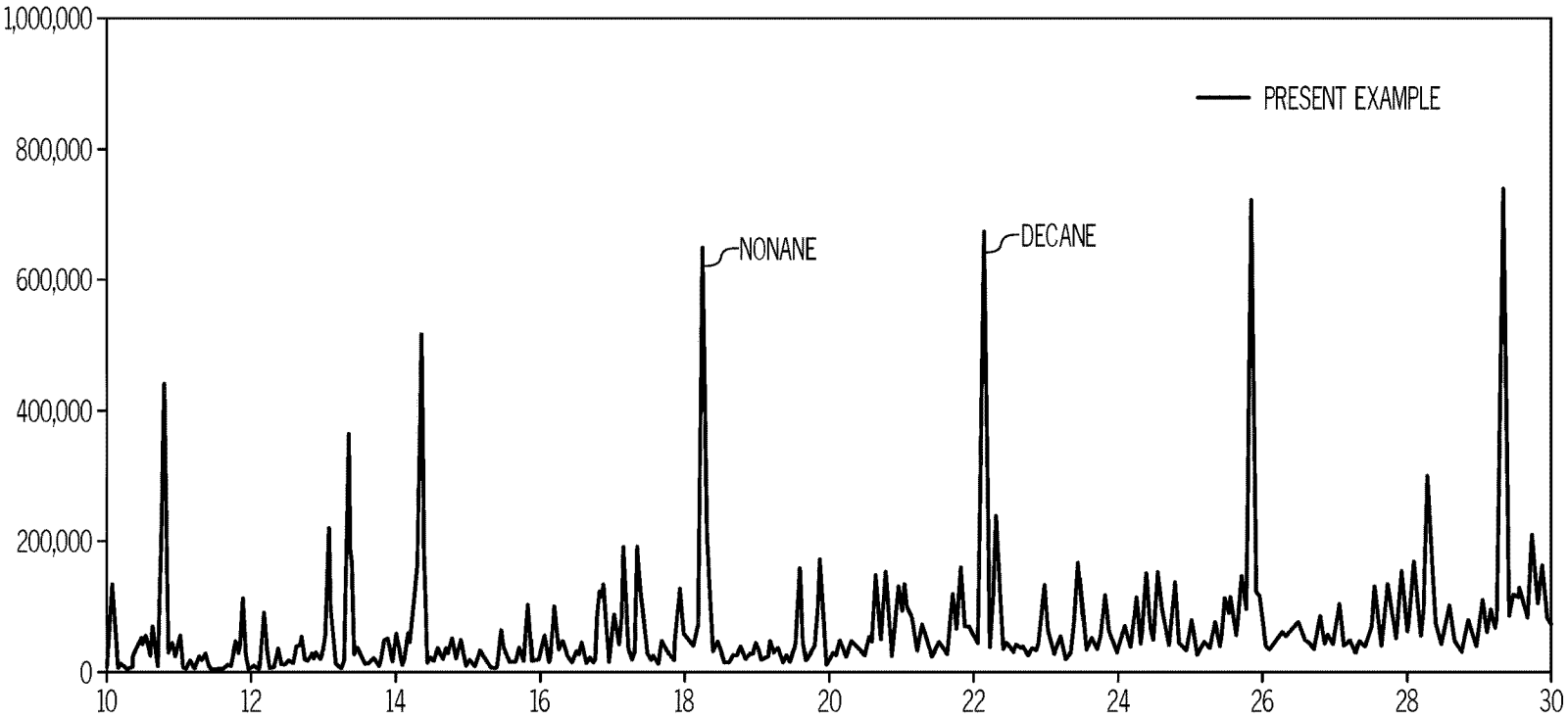
FIG. 6 is a gas chromatography-mass spectrometry (GC-MS) spectra of a middle outlet product stream according to a Present Examples described in the Examples below.

FIGS. 4 and 6 depict GC-MS spectra of the middle outlet product 152 of the Present Example. As shown clearly, n-paraffinic compounds, such as nonane and decane, are dominant over olefins, such as 1-nonene and 1-decene, respectively. This surprisingly demonstrates that the olefins are predominantly discharged from the bottom port. The lower outlet product 154 from the bottom port of the second reactor 150 was not sampled during the operation. It was analyzed after completion of the run and found to have a concentrated amount of asphaltene. From mass balance, the middle outlet product 152 from the middle port of the second reactor 150 was 86 wt % of whole oil product.

Figure 5:
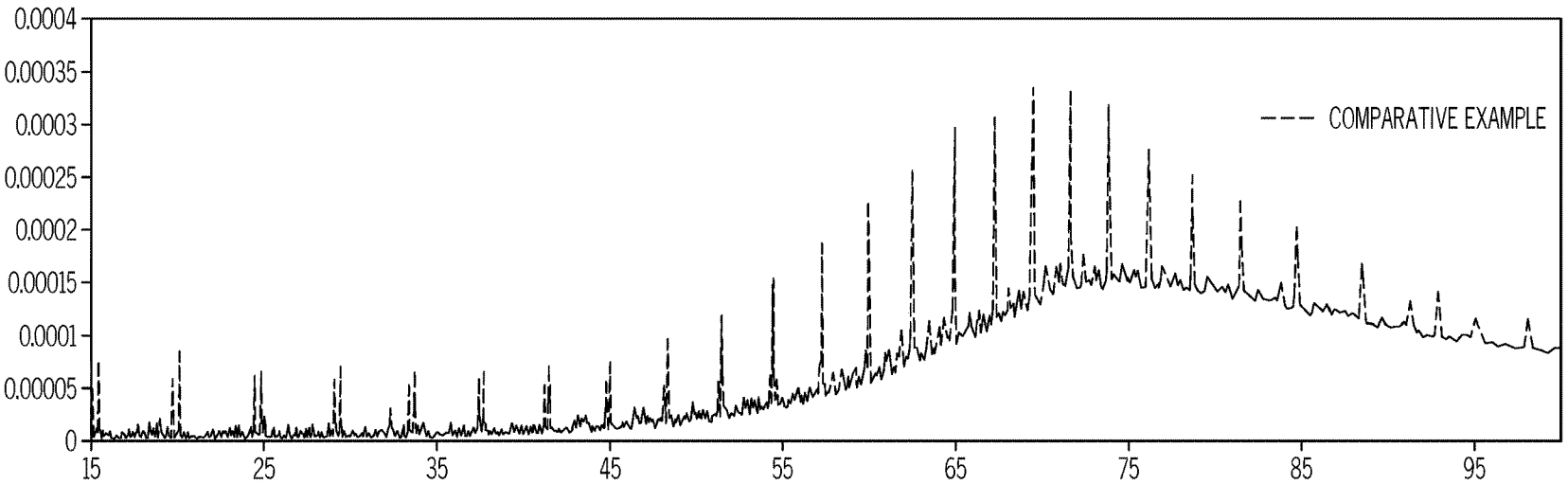
FIG. 5 is a gas chromatography-mass spectrometry (GC-MS) spectra of a bottom outlet product stream according to a Present Examples described in the Examples below.
Figure 7:
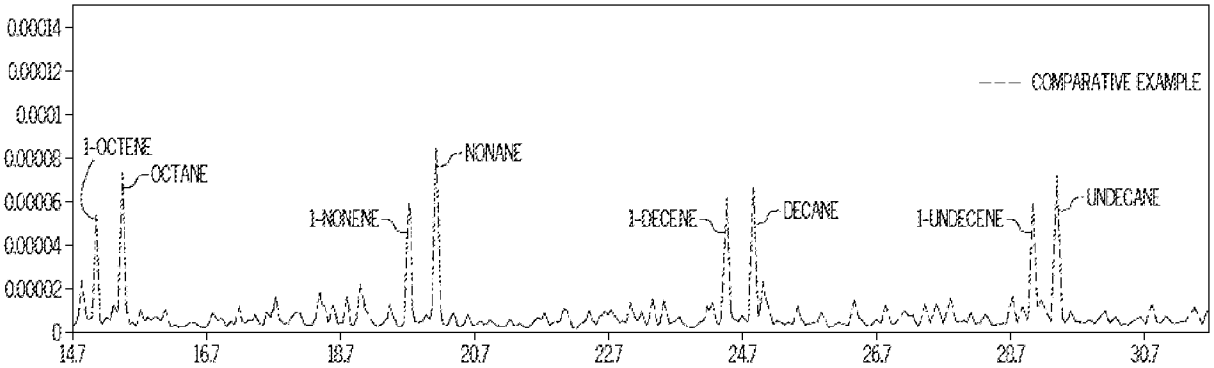
FIG. 7 is a gas chromatography-mass spectrometry (GC-MS) spectra of a bottom outlet product stream according to a Present Examples described in the Examples below.

In contrast as shown in the GC-MS spectra of FIGS. 5 and 7, the bottom product of the second reactor 150 in the Comparative Example show peaks of much lesser intensity than the middle outlet product 152 of the Present Example. As shown in FIG. 7, there are peaks for the paraffins and the olefins, thus indicating that paraffins are not dominant over olefins, which is the case with the middle outlet product 152.

It should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

What is claimed is:

1. A process for producing paraffins from a petroleum-based composition comprising long chain aromatics, the process comprising:

mixing a supercritical water stream with a pressurized, heated petroleum-based composition to create a combined feed stream, wherein the pressurized, heated petroleum-based composition is at a pressure greater than the critical pressure of water and at a temperature greater than 75° C., introducing the combined feed stream to a first reactor through an inlet port of the first reactor, where the first reactor operates at a first temperature greater than the critical temperature of water and a first pressure greater than the critical pressure of water;

cracking at least a portion of the long chain aromatics in the first reactor to form a first reactor product, where the first reactor product comprises water, paraffins, short chain aromatics, olefins, and unconverted long chain aromatics;

introducing the first reactor product to a second reactor through an upper inlet port of the second reactor, the second reactor operating at a second temperature less than the first temperature but greater than the critical temperature of water and a second pressure greater than the critical pressure of water, wherein the second reactor is a downflow reactor comprising the upper inlet port, a lower outlet port, and a middle outlet port disposed between the upper inlet port and the lower outlet port;

wherein the second reactor has a volume less than or equal to a volume of the first reactor;

wherein a middle outlet product is passed out of the second reactor though the middle outlet port, the middle outlet product comprising paraffins and short chain aromatics; and wherein a lower outlet product is passed out of the second reactor through the lower outlet port, the lower outlet product comprising multi-ring aromatics and oligomerized olefins;

cooling the middle outlet product to a temperature less than 200° C.;

reducing the pressure of the cooled middle outlet product to form a cooled, depressurized middle stream with a pressure from 0.05 MPa to 2.2 MPa;

separating the cooled, depressurized middle stream into a gas-phase stream and a liquid-phase stream, where the liquid-phase stream comprises water, short chain aromatics, and paraffins;

separating the liquid-phase stream into a water-containing stream and an oil-containing stream, where the oil-containing stream comprises paraffins and short chain aromatics; and separating the oil-containing stream into a stream comprising the paraffins and a stream comprising the short chain aromatics.

2. The process of claim 1, wherein the separating of the oil-containing stream is performed in an extraction unit.

3. The process of claim 2, wherein the extraction unit is a solvent extraction unit.

4. The process of claim 2, wherein the separating of the oil-containing stream further comprises a distillation unit upstream of the extraction unit.

5. The process of claim 1, wherein the first reactor and the second reactor are absent a catalyst and an external supply of hydrogen gas.

6. The process of claim 1, wherein a ratio of the volume of the first reactor to the volume of the second reactor is 0.1:1 to 1:1 at standard ambient temperature and pressure.

7. The process of claim 1, further comprising delivering the lower outlet product to a mechanical mixer.

8. The process of claim 1, wherein the multi-ring aromatics include asphaltenes.

9. The process of claim 1, further comprising injecting plug remover solution into the lower outlet port.

10. The process of claim 9, wherein the plug remover solution comprises toluene.

11. The process of claim 1, wherein the lower outlet port is not continuously opened.

12. The process of claim 1, wherein the middle outlet product includes less than 1 weight percent of olefins.

13. The process of claim 1, wherein the petroleum-based composition comprises atmospheric residue, vacuum gas oil, or vacuum residue.

14. The process of claim 1, wherein a ratio of a flow rate of the supercritical water stream and a flow rate of the pressurized, heated petroleum-based composition is 5:1 to 1:1 at standard ambient temperature and pressure.

15. The process of claim 1, wherein the first reactor, the second reactor, or both include agitating or stirring devices.

* * * * *